US005124893A

United States Patent [19]

Jeng

[11] Patent Number: 5,124,893

[45] Date of Patent: Jun. 23, 1992

[54] SCREW DRIVER HAVING ILLUMINATING MEANS MOUNTED THERETO

[76] Inventor: Jong-Pyng Jeng, No. 9-1, Ting-Nan, Ying-Chuan Li, Huwei Chen, Yunlin, Hsien, Taiwan

[21] Appl. No.: 782,665

[22] Filed: Oct. 25, 1991

[51] Int. Cl.[5] ..... B25B 23/18

[52] U.S. Cl. ..... 362/120

[58] Field of Search ..... 362/120

[56] References Cited

U.S. PATENT DOCUMENTS 2,670,427 2/1954 Barlet et al. ..... 362/120

4,768,137 8/1988 Hwaw et al. ..... 362/120

*Primary Examiner*—Carroll B. Dority

*Attorney, Agent, or Firm*—Darby & Darby

[57] ABSTRACT

A screw driver includes an illuminating unit fixed to a slidable member slidably mounted on the shank of the screw driver. The slidable member also has a holding member by which it can stay stationary on the shank.

7 Claims, 5 Drawing Sheets

SCREW DRIVER HAVING ILLUMINATING MEANS MOUNTED THERETO

BACKGROUND OF THE INVENTION

1. Field of Invention

This invention relates to a screw driver, more particularly to one having an illuminating means mounted thereto so that such a screw driver is capable of operating in darkness, as well as in day light.

2. Description of the Related Art

A screw driver is a very useful tool applicable in various fields, such as in repairing operation and the like. It is a well known fact that it is not a problem to use a screw driver in the day time, but while working at night or in darkness it is not possible to see an object on which the screw driver is working. Holding a torch in one hand while the remaining hand working with a screw driver is very inconvenient and cumbersome for an operator.

There already exists a screw driver having an illuminating unit fixedly attached at a front portion of the handle of the screw driver. Though such a screw driver can offer some light, it can only cover a limited range because the illuminating unit is fixed to the front of the handle while the working tip is still a distance away therefrom. The shank by itself can cause a shadow over a workpiece, i.e. a screw or can at least reduce the clear visibility of the workpiece. Therefore, in order to provide clear visibility, the length of the shank of the screw driver must be taken into consideration. The shank of such screw driver is generally made very short in order to overcome said drawback. When the shank is shortened, it is not applicable in some cases, for example, when it is necessary to screw at the bottom of a bore deeper than the length of the shank of the driver.

There is still another kind of screw driver, which having a light reflective means mounted right beside the illuminating unit which can convey rays of light to the tip of the screw driver so that one can se the working spot clearer. Though the above-mentioned drawback is somewhat solved by this screw driver construction but the installation of the reflective means has a greater cost and the limited length of the shank is not fully solved.

SUMMARY OF THE INVENTION

Therefore, it is the main object of the present invention to provide a screw driver with an illuminating unit under a condition that the length of the shank of the driver is not subject to limitation and at the same time clear of the above-mentioned drawbacks.

According to the present invention, the screw driver has an illuminating unit which is fixed to a slidable piece which in turn is slidably mounted to a front portion of the handle of the screw driver so that said illuminating unit can be moved to be adjacent to the tip of the shank of the screw driver in order to provide a full, clear view of a working spot. The slidable piece also has a holding means by which the slidable piece can stay in a stationary position on the shank.

BRIEF DESCRIPTION OF THE DRAWINGS

Other features and advantages of the present invention will become more apparent in the following detailed description, including drawings, all of which show a non-limiting form of the invention, and of which.

DETAILED DESCRIPTION OF THE PREFERRED EMBODIMENT

Figure 1:
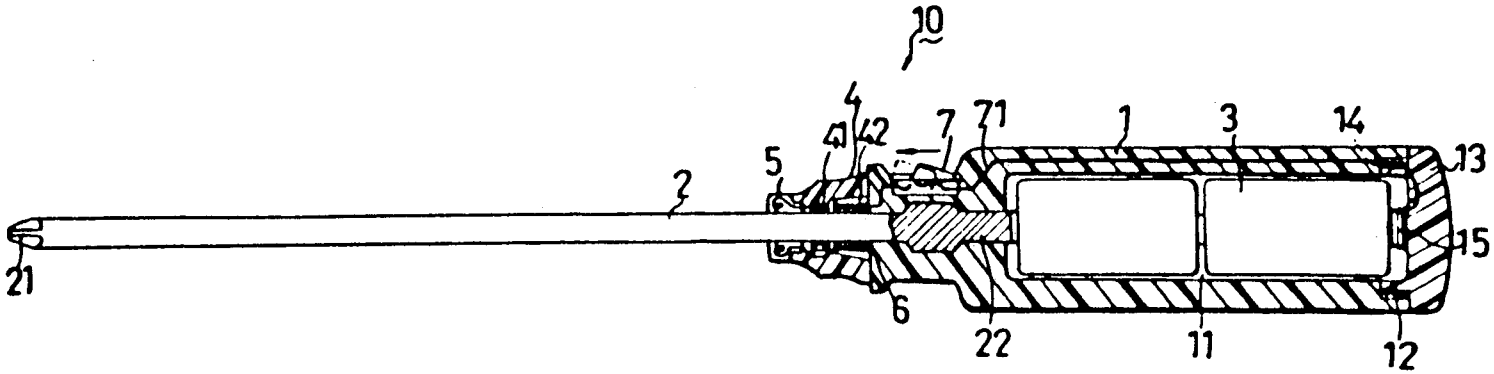
FIG. 1 is a cross sectional view of a screw driver of the present invention.

Referring to FIG. 1, a screw driver (10) according to the present invention is shown to comprise a handle (1), a shank (2) having a front portion with a tip (21) and a rear portion fixedly attached to a front end of said handle (1), a cell means (3), a slidable piece (4), an illuminating means (5), a coil of insulating wire (6) and an on-off switch (7) the connecting relationships thereof will be described in detailed hereinafter.

The handle (1) is generally in shape of a hollow cylinder and a compartment (11) is formed within the same to receive a cell means (3). The handle is generally made of a substantially hard plastic material or any other suitable material. For the purpose of firm gripping, the outer surface of the handle can be provided with tractions so that the hand of an operator will not slip. The compartment (11) is opened at the bottom end of the handle (1). The connecting means (12) thereof is made of metal and has a threaded formation so that an electric current can pass therethrough. The bottom end is capped by a plastic lid (13). It is to be observed that the inner surface (14) of the lid (13) is made of metal and threaded in order to match with the threaded portion (12) and has a metal coil spring (15) to compress the cells (3) in tight contact.

The shank (2) is generally made of a very hard metal whose front tip (21) end is usually flat so as to fit into a slot formed on the head of the screw in order for the screw to be turned. The rear end (22) of the shank (2) is in contact with a negative terminal of the cell means (3).

The slidable piece (4) is generally made of a transparent or non-transparent plastic material and is slidably mounted on the shank (2). The illuminating unit (5), such as a bulb, is fixedly attached to the slidable piece (4) and has wire connections (6,41) with the cell means (3). The wire connections are well known arts and are not directly concerned with the present invention so that detailed description of such will be omitted here. In order to switch on or off the bulb (5) at any desired time, an on-off switch (7) is provided on the handle (1) by a known art which switch being a full circuit switch can connect or disconnect the wire connections.

Figure 7:
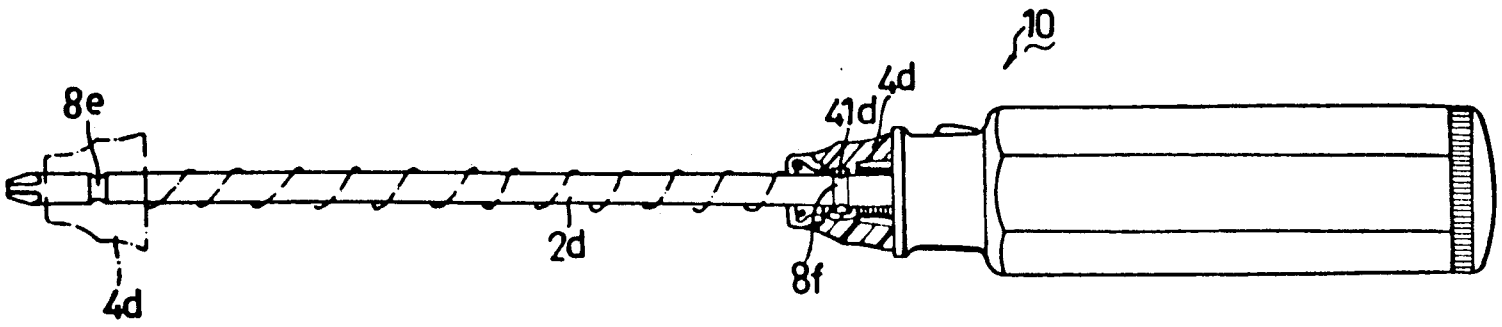
FIG. 7 is a screw driver of the present invention with a different configuration.

In order for the illuminating unit (5) to be able to slide up and down the shank (2) and still maintain an electrical connection with the cell means (3), the wire connection (6) is formed by a coil of insulated wire which is provided around the shank and is received in the recess portion (42) of the slidable piece (4) and connected to the wire 71 which is connected to a positive terminal of the cell means (3). A clamp member (41), made of metal, is provided within the slidable piece (4) which can clamp the shank (2) so that the former is kept stationary with respect to the later while in operation and is electrically connected to the negative terminal of the cell means (3) via the shank. A circular recess (8*e*,8*f*) is formed adjacent to the front end and rear end of the shank (2*d*) respectively into which the clamp (41) falls into and clamping the slidable piece with respect to the shank as shown in FIG. 7.

Figure 2:
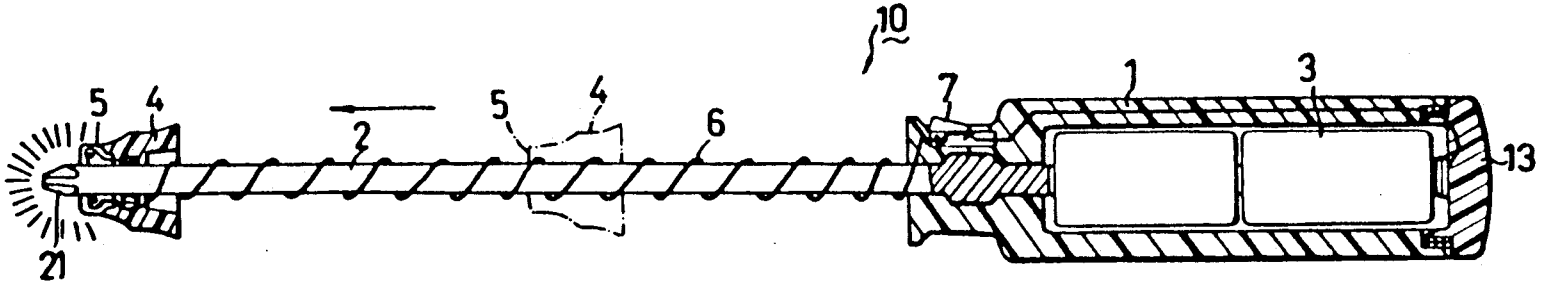
FIG. 2 shows the screw driver of the present invention being applied in a first way.
Figure 3:
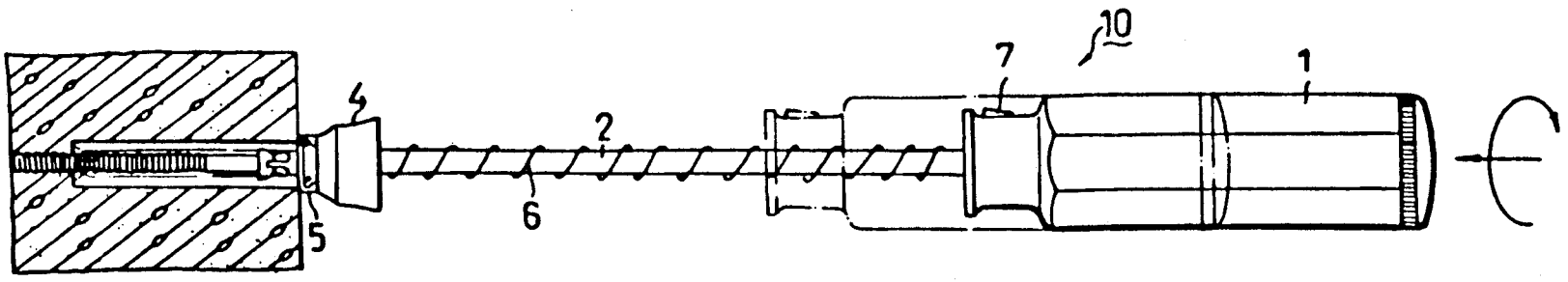
FIG. 3 shows the screw driver of the present invention being applied in a second way.

FIG. 2 shows the illuminating unit being moved to a position adjacent to the tip in order for one to see the workpiece more clearly. Thus there will be no shadow of the shank (2) which will overcast the working spot as in the prior art screw driver. FIG. 3 shows the tip (21) of the shank (2) of the screw driver (10) being inserted into the depth of a bore, with the bulb providing clear visibility of the object, of which action the prior screw driver is uncapable.

Figure 4:
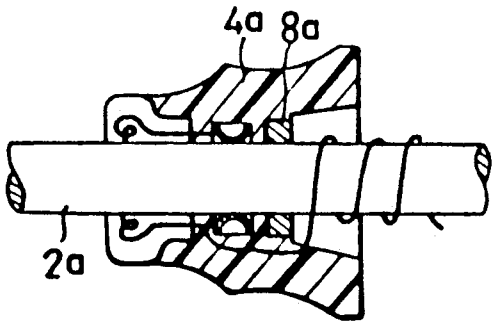
FIG. 4 is a detailed view of a first preferred embodiment of a slidable piece of the screw driver of FIG. 1.

Referring to FIG. 4, in addition to the original clamp (not numbered), a magnetic piece (8*a*) can be provided within the slidable piece (4*a*) so that the slidable piece can stick more firmly on the shank (2*a*).

Figure 5:
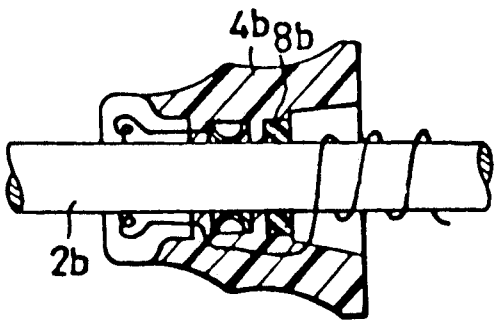
FIG. 5 is a detailed view of a second preferred embodiment of a slidable piece of the screw driver of FIG. 1.

Alternatively, a clamping piece (8*b*) made of a rubber material can be provided within the slidable piece (4*b*), in addition to the original clamp (not numbered), so that the slidable piece can provide an additional clamping force on the shank (2*b*) as shown in FIG. 5.

Figure 6:
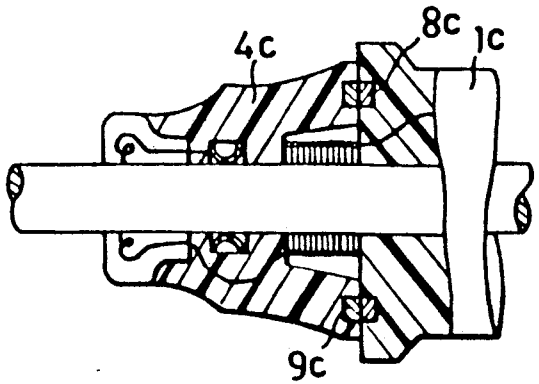
FIG. 6 is a detailed view of a third preferred embodiment of a slidable piece of the screw driver of FIG. 1.

In one embodiment, a magnetic piece (9*c*) can be provided on the rear portion of the slidable piece (4*c*) facing the front end of the handle and another magnetic piece (8*c*) can be provided on the front side of the handle (1*c*) so that the former will engage with the latter and stay together in a normal condition. Please see in FIG. 6.

With the invention thus explained, it is obvious to those skilled in the art that various modifications and variation can be made without departing from the scope and spirit of the present invention. It is therefore intended that this invention be limited only as in the appended claims.

I claim:

1. A screw driver including a handle and a shank having a front end with a tip for turning a screw and a rear end fixedly attached to a front end of said handle, said handle having a cell means, an illuminating unit, means for electrically connecting said illuminating unit to said cell means to form a circuit, and an on-off switch mounted to said circuit;

characterized in that said screw driver further comprises a slidable piece slidably mounted on said shank, said illuminating unit being fixed to said slidable piece, and means for holding said slidable piece in a stationary position with respect to said shank.

2. A screw driver as claimed in claim 1, wherein said electrical connecting means includes a coil of insulating wire provided around said shank between said slidable piece and said handle, and connects said illuminating means to said cell means so as to form said circuit.

3. A screw driver as claimed in claim 1, wherein said slidable piece further includes a receiving space on a side facing said front end of said handle to receive said coil of insulating wire therein.

4. A screw driver as claimed in claim 1, wherein said holding means is a magnetic piece provided within said slidable piece and is capable of magnetically sticking on said shank.

5. A screw driver as claimed in claim 1, wherein said holding means is a metal clamp provided within said slidable piece and around said shank.

6. A screw driver as claimed in claim 1, wherein said shank further includes a first circular recess formed on said front end adjacent to said tip thereof, a second circular recess formed on said rear end adjacent to said front end of said handle.

7. A screw driver as claimed in claim 1, wherein said front end of said handle has a first magnetic piece and said slidable piece has a second magnetic piece on a side facing said front end of said handle.

* * * * *